US008602267B2

(12) United States Patent
Drennow et al.

(10) Patent No.: US 8,602,267 B2
(45) Date of Patent: Dec. 10, 2013

(54) DEVICE FOR DISCHARGING LIQUID OR SUBSTANTIALLY LIQUID PRODUCTS FROM A COMPRESSIBLE CONTAINER OF FLEXIBLE MATERIAL

(75) Inventors: Sten Drennow, Lund (SE); Stefan Cedergren, Bunkeflostrand (SE)

(73) Assignee: Asept International AB, Lund (SE)

( * ) Notice: Subject to any disclaimer, the term of this patent is extended or adjusted under 35 U.S.C. 154(b) by 0 days.

(21) Appl. No.: 13/512,011

(22) PCT Filed: Nov. 23, 2010

(86) PCT No.: PCT/SE2010/051292

§ 371 (c)(1),
(2), (4) Date: May 24, 2012

(87) PCT Pub. No.: WO2011/065903

PCT Pub. Date: Jun. 3, 2011

(65) Prior Publication Data

US 2013/0001256 A1 Jan. 3, 2013

(30) Foreign Application Priority Data

Nov. 25, 2009 (SE) ..... 0901486

(51) Int. Cl.
*B65D 37/00* (2006.01)

(52) U.S. Cl.
USPC ..... 222/214; 222/391; 222/105; 222/386.5; 222/571

(58) Field of Classification Search
USPC ..... 222/214, 103, 391, 325, 326, 327, 100, 222/105, 215, 386, 571, 183.5
See application file for complete search history.

(56) References Cited

U.S. PATENT DOCUMENTS 3,774,819 A * 11/1973 Bratton ..... 222/391
3,904,083 A * 9/1975 Little ..... 222/82
4,429,813 A * 2/1984 De Freitas ..... 222/207

(Continued)

FOREIGN PATENT DOCUMENTS

DE 19817627 A1 10/1999
DE 102004038698 B3 8/2005

(Continued)

OTHER PUBLICATIONS

International Search Report for PCT Patent Application No. PCT/SE2010/051292, mailed on Jan. 17, 2011, 4 pages.

(Continued)

*Primary Examiner* — Paul R Durand
*Assistant Examiner* — Randall Gruby
(74) *Attorney, Agent, or Firm* — Morrison & Foerster LLP

(57) ABSTRACT

The present invention relates to a device for discharge of liquid or substantially liquid products (2), preferably foodstuffs, e.g. mayonnaise, mustard, ketchup or dressing, from a compressible container (3) made of flexible material, preferably of plastic bag type. The container (3) is placed in an outer container (7) and is compressible by a compression device (4) in order to feed product (2) out therefrom through a nozzle (6). The invention is characterised in that a compression means (9) which forms part of the compression device (4) is disposed on a piston (17) adapted to being subjected to movements in a portioning direction (P3) so that the movable compression means (9) squeezes the container (3) in the outer container (7), and that the piston with its compression means (9) can perform a return movement in a return direction (P4) which is opposite to the portioning direction (P3).

12 Claims, 3 Drawing Sheets

(56) References Cited

U.S. PATENT DOCUMENTS

| | | | | |
|---|---|---|---|---|
| 4,603,676 | A * | 8/1986 | Luoma | 124/25 |
| 4,805,810 | A * | 2/1989 | Czetwertynski | 222/319 |
| 4,986,588 | A * | 1/1991 | Price | 294/50.7 |
| 5,046,648 | A * | 9/1991 | Herbstzuber | 222/638 |
| 5,069,364 | A * | 12/1991 | McGill | 222/95 |
| 5,409,281 | A * | 4/1995 | Price | 294/50 |
| 5,529,225 | A * | 6/1996 | Chang | 222/391 |
| 5,553,740 | A * | 9/1996 | King et al. | 222/1 |
| 5,823,403 | A * | 10/1998 | Schneider | 222/391 |
| 5,878,915 | A * | 3/1999 | Gordon et al. | 222/82 |
| 6,019,251 | A * | 2/2000 | Koga | 222/94 |
| 6,131,766 | A * | 10/2000 | King et al. | 222/1 |
| 6,161,727 | A * | 12/2000 | Gordon et al. | 222/82 |
| 6,182,862 | B1 * | 2/2001 | McGill | 222/1 |
| 6,234,348 | B1 * | 5/2001 | Okamura et al. | 222/1 |
| 6,264,071 | B1 * | 7/2001 | Dentler | 222/391 |
| 6,553,670 | B2 * | 4/2003 | Chang | 30/92 |
| 6,722,530 | B1 * | 4/2004 | King et al. | 222/82 |
| 6,860,407 | B2 * | 3/2005 | Gosselin | 222/105 |
| 7,168,933 | B2 * | 1/2007 | Stern | 425/87 |
| 7,364,054 | B2 * | 4/2008 | Klein | 222/334 |
| 2008/0023495 | A1 * | 1/2008 | Takayama et al. | 222/391 |
| 2013/0001256 | A1 * | 1/2013 | Drennow et al. | 222/214 |

FOREIGN PATENT DOCUMENTS

| | | | |
|---|---|---|---|
| WO | 2004/067386 | A2 | 8/2004 |
| WO | 2005/097354 | A1 | 10/2005 |
| WO | 2008/079089 | A1 | 7/2008 |
| WO | 2008/115047 | A1 | 9/2008 |

OTHER PUBLICATIONS

Extended European Search Report for European Patent Application No. 10833667.8, mailed on Mar. 7, 2013, 5 pages.

* cited by examiner

DEVICE FOR DISCHARGING LIQUID OR SUBSTANTIALLY LIQUID PRODUCTS FROM A COMPRESSIBLE CONTAINER OF FLEXIBLE MATERIAL

CROSS REFERENCE TO RELATED APPLICATIONS

This is a U.S. National Phase patent application of PCT/SE2010/051292, filed Nov. 23, 2010, which claims priority to the Swedish Patent Application No. 0901486-1, filed Nov. 25, 2009, each of which is hereby incorporated by reference in the present disclosure in its entirety.

TECHNICAL FIELD

The present invention relates to a device for discharge of liquid or substantially liquid products, preferably foodstuffs, e.g. mayonnaise, mustard, ketchup or dressing, from a compressible container made of flexible material.

STATE OF THE ART

Specification WO 2008/079089 A 1 describes a discharge device whereby products are fed out from a plastic bag through a nozzle. The nozzle is provided with a valve device to prevent such elements of the product as are, after a discharge, still present in the nozzle from dripping out of the nozzle. Providing a nozzle with a fully effective valve device for this purpose does however mean that the cost of the nozzle would be high and the nozzle would therefore have to be reused, entailing having to clean the nozzle, a time-consuming and troublesome procedure. Nor would it ever be possible to be certain that the cleaning was done properly so as to meet the high hygiene requirements which apply to discharge devices for foodstuffs.

Specification DE 102004038698 B3 describes a discharge device for feeding products out from a container of plastic pot type. That discharge device has a compression device for squeezing the plastic pot and there is a device which allows the compression device to perform return movements. However, that discharge device cannot be used for feeding products out from plastic bags, nor does it prevent after-dripping therefrom.

PROBLEM SOLUTION

The invention solves the problems of the state of the art by having the features indicated in the claims set out below. Said features make it possible for the discharge device to feed products out from plastic bags and prevent the occurrence of after-dripping therefrom.

LIST OF DRAWINGS

DESCRIPTION OF A PREFERRED EMBODIMENT OF A DEVICE ACCORDING TO THE INVENTION

Figure 1:
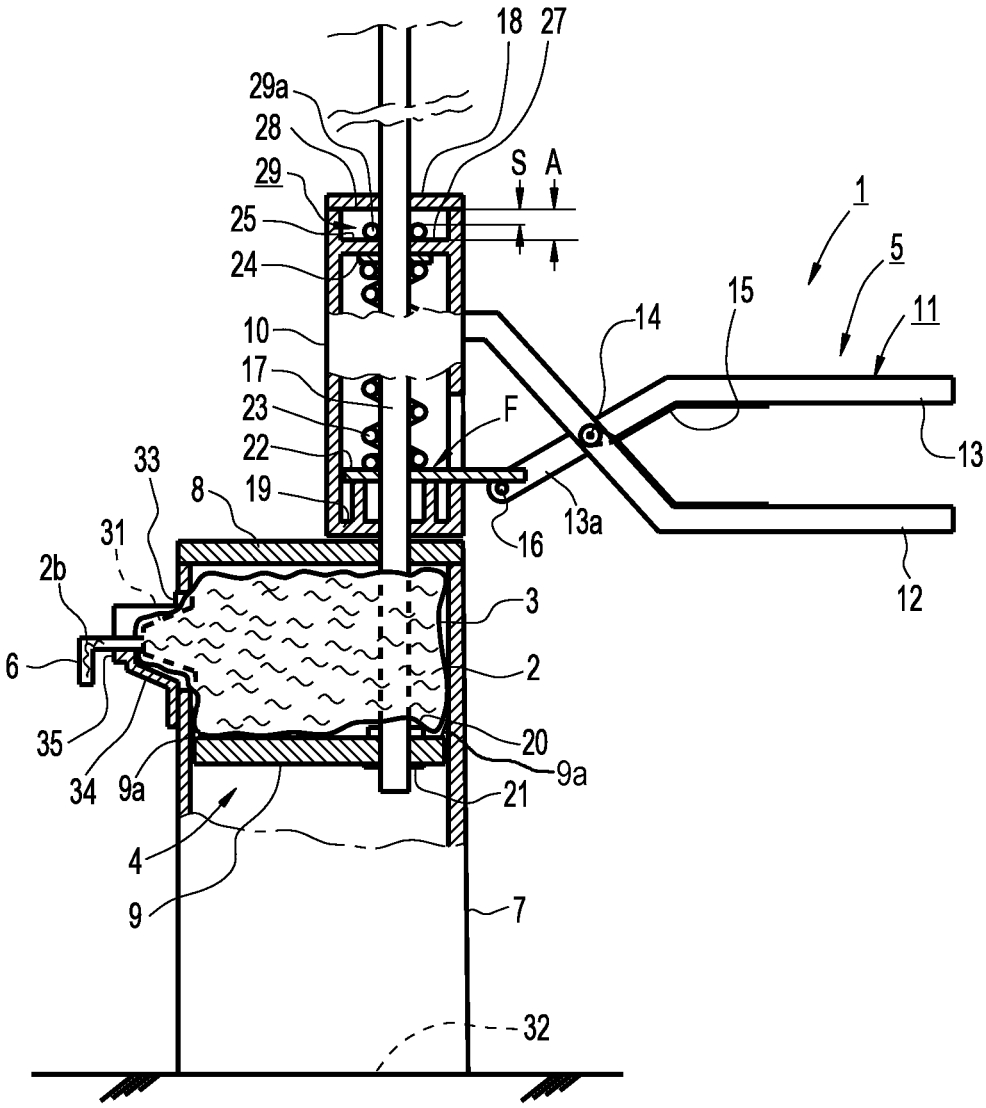
FIG. 1 depicts a device according to the invention in a vertical section, before discharge of a product from a container placed therein.

FIG. 1 depicts a device 1 for discharge of liquid or semi-liquid products 2 from a compressible container 3 made of flexible wall material. The liquid product is preferably a foodstuff, e.g. mayonnaise, mustard, ketchup or dressing, and said foodstuff may comprise quite large components, e.g. pieces of gherkin. The container 3 may be of plastic bag type with walls made of such flexible material that it can be squeezed without bursting.

The discharge device 1 has a compression device 4 and a manually operable operating device 5 which can be subjected to operating movements in order to operate the compression device 4 with the object of squeezing the plastic bag 3 in order to feed the product 2 out through a nozzle 6. The compression device 4 is disposed with respect to an outer container 7 and comprises a fixed compression means 8 and a movable compression means 9. The fixed compression means 8 is firmly attached to the outer container 7 and the lower compression means 8 is disposed in the latter in such a way as to be movable in the height direction. The plastic bag 3 is placeable between said compression means 8 and 9. A housing 10 is placed on top of the outer container 7.

The operating device 5 has a device 11 resembling a pair of tongs, with two limbs 12, 13, the limb 12 being firmly disposed on the housing 10 and the limb 13 being pivotably connected to the limb 12 via a hinge pin 14 which supports a spring 15 which abuts against the insides of the limbs 12, 13 so that it pushes them apart and keeps them apart after being operated. The forward portion 13*a* of the limb 13 has a stud 16 intended to transmit the operating movements of the operating device 5 to the compression device 4.

The compression device 4 has also a piston 17 or equivalent, which is disposed vertically and extends through the housing 10 and down into the outer container 7. This piston 17 is more precisely supported for vertical movement in upper portions 18 and lower portions 19 of the housing 10, extends movably vertically through the upper compression means 8 of the outer container 7 and has at the bottom the lower compression means 9 fastened to it by nuts 20, 21 or similar fastening means.

The portion of the piston 17 which is within the housing 10 extends through a movement transmission means 22 and a coil compression spring 23 which abuts at the bottom against the movement transmission means 22 and at the top against a portion 25 of the housing 10, possibly via a washer 24.

Figure 2:
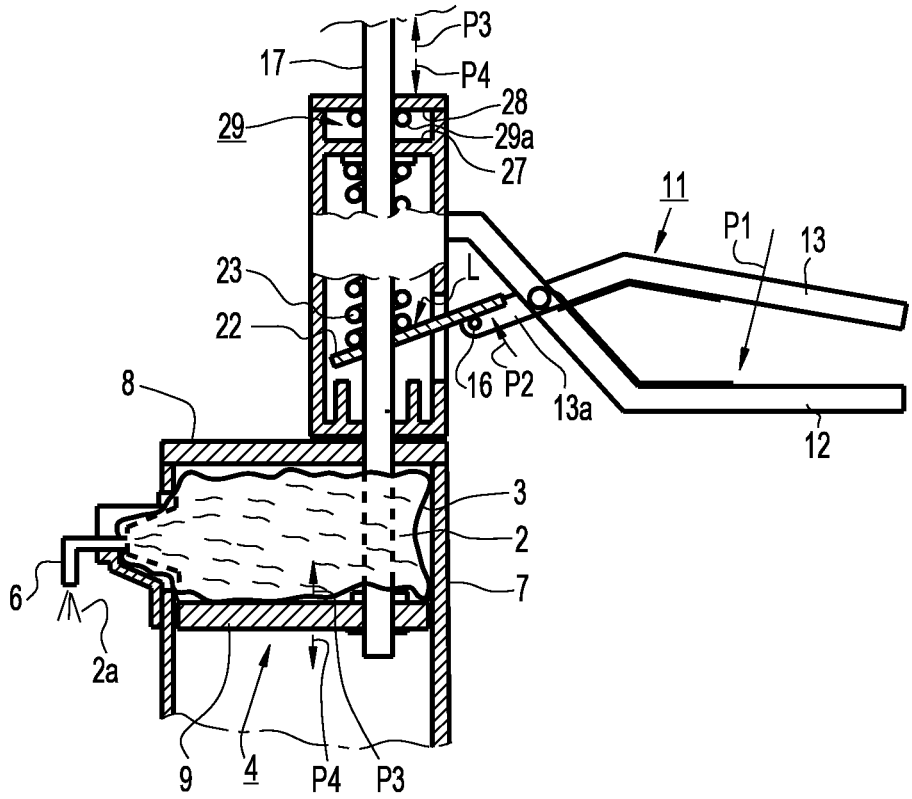
FIG. 2 depicts the device according to FIG. 1 during discharge of said product from the container.

Discharge of a portion of product 2 from the plastic bag 3 is effected by taking hold of the limbs 12, 13 and pressing the limb 13 downwards towards the limb 12 in a portioning direction P1 (see FIG. 2). This causes the forward portions 13*a* of the limb 13 to pivot in an upward direction P2 with the result that the stud 16 moves the movement transmission means 22 from a releasing position F (see FIG. 1) to a locking position L (see FIG. 2). In the releasing position F the means 22 allows the piston 17 to move relative to it in vertical directions, whereas in the locking position it is firmly locked to the piston 17 by clamping, enabling it to move the piston 17 in an portioning direction P3. Moving the piston 17 in the portioning direction P3 causes the lower compression means 9 firmly attached to the piston to move in the same direction P3 and to squeeze the plastic bag 3 so that a portion 2*a* of the product 2 is discharged therefrom through the nozzle 6.

When the movement transmission means 22 causes the piston 17 to move in the portioning direction P3 the coil compression spring 23 is tightened, and when the limb 13 is released after the discharge of the portion 2*a* the coil compression spring 23 will push the movement transmission means 22 back to its releasing position F.

A device 29 which allows return movement is adapted to allowing the compression means 9, after having been subjected to a movement in the portioning direction P3, to perform a return movement in a return direction P4 which is opposite to the portioning direction P3 and is therefore in this case directed downwards. During this movement in the return direction P4, the movable compression means 9 will move in the same direction P4, i.e. in this case downwards, which means that the plastic bag 3 expands or may expand somewhat, thereby causing its interior to become somewhat larger, with the result that the pressure in the nozzle 6 ceases and such elements 2*b* of the product 2 as are present therein are prevented from dripping out of it. Depending on the degree of expansion of the plastic bag 3, the return movement may even result in elements 2*b* of the product 2 which are still in the nozzle being sucked in towards the plastic bag 3.

In the embodiment depicted, the device 29 which allows the return movement has two stop surfaces 27, 28 disposed above one another and, between them, at least one ring 29*a* or an equivalent means threaded on the piston 17. The stop surface 28 may for example take the form of the inside of the upper portion 18 of the housing, and the stop surface 27 takes the form of the upper side of such a portion 25 of the housing 10 as is situated below the upper portion 18. The ring 29*a* has resilient characteristics and can by friction between it and the piston 17 accompany the movement of the piston and thus be moved by the piston 17 between the stop surfaces 27, 28 when the piston 17 moves upwards or downwards. When the piston 17 is caused to move upwards in the portioning direction P3, the ring 29*a* thus accompanies it and is moved from the stop surface 27 to the stop surface 28 which brings to a halt the upward movement of the ring 29*a*. When the ring 29*a* has reached the stop surface 28, the friction between it and the piston 17 allows the piston 17 to slide in the ring 29*a* and continue moving upwards in the portioning direction P3. When the piston 17 is no longer being caused to move upwards in the portioning direction P3, it can move downwards in the return direction P4 until the ring 29*a*, by its friction against the piston 17, brings the movement of the piston to a halt when it comes into contact with the stop surface 27.

The return movement in the return direction P4 may be effected by means of the plastic bag 3. Thus the weight of the plastic bag 3 with product 2 therein may be utilised to press down the lower compression means 9, the piston 17 and the ring 29*a* so that all three are subjected to the return movement in the return direction P4. The more product 2 is discharged from it, the lighter the plastic bag 3 becomes, and if the weight of the plastic bag 3 is no longer sufficient its elastic characteristics causing it to endeavour to revert to its original shape may instead be utilised to exert such a force on the lower compression means 9, the piston 17 and the ring 29*a* that they move downwards in the return direction P4. The more the plastic bag 3 is squeezed, the greater will be the strength of its endeavour to revert to its original shape, which can thus be utilised to effect the movement in the return direction P4.

The magnitude S of the return movement is determined by the distance between the ring 29*a* and, for example, the stop surface 28, as in the embodiment depicted. Said magnitude S may however be some other magnitude and be varied as necessary, e.g. by providing a thicker or thinner ring 29*a* than that depicted, by providing more than one ring 29*a* or by altering the distance A between the stop surfaces 27, 28. It is also possible for the stop surfaces 27, 28 to be situated on parts whose mutual spacing A is variable.

To make it possible for the plastic bag 3 to be placed in the outer container 7 between the compression means 8, 9, the outer container 7 has a lower aperture 32 and the length of the piston 17 is with advantage such that the lower compression means 9 can be drawn far enough out from the outer container 7 through its lower aperture 32 to enable the plastic bag to be put into the outer container 7 via the lower aperture 32 without the piston 17 having to be drawn out from the housing 10. The plastic bag 3 is introduced into the outer container 7 until it abuts against the upper compression means 8, after which the lower compression means 9 is put back into the outer container 7 until it abuts against the plastic bag 3.

In the embodiment depicted, the plastic bag 3 has an inner connecting portion 31 disposed within it. The nozzle 6 has a connecting portion 6*a* so configured that it is possible to use it for opening the plastic bag 3 and thereafter for connecting the nozzle 6 firmly to the inner connecting portion of the plastic bag 3. The nozzle 6 thus has both an opening function and a connecting function.

The outer container 7 may have at the top a lateral aperture 33 through which the nozzle 6 or portions of the plastic bag 3 which comprise the nozzle 6 may be caused to protrude from the outer container 7. The outer container 7 may have on the outside below the lateral aperture 33 a bracket 34 forming a hollow 35 both for the portions of the plastic bag 3 which comprise the inner connecting portion 31 and for the nozzle 6 so that said bracket 34 holds firmly the portions of the plastic bag 3 which comprise the inner connecting element 31, and also the nozzle 6.

The device 29 which allows return movement makes it possible to use nozzles without drip-preventing valves, thereby making it possible for the nozzles to have very simple shapes and be manufactured at such a low price that they are suitable for once-only use, i.e. when a plastic bag with nozzle is empty it is removed together with its nozzle and a full plastic bag with a new nozzle is inserted and is thereafter emptied by means of the device 1.

The invention is not limited to the variants described above and depicted in the drawings but may be varied within the scope of the claims set out below. Examples of further variants which may be cited are the compression device possibly having two movable compression means instead of one, the configuration of the operating device possibly being other than resembling a pair of tongs, and the device effecting return movements possibly comprising for example two mutually cooperating means connected to one another with such play that a return movement can take place between them.

Figure 3:
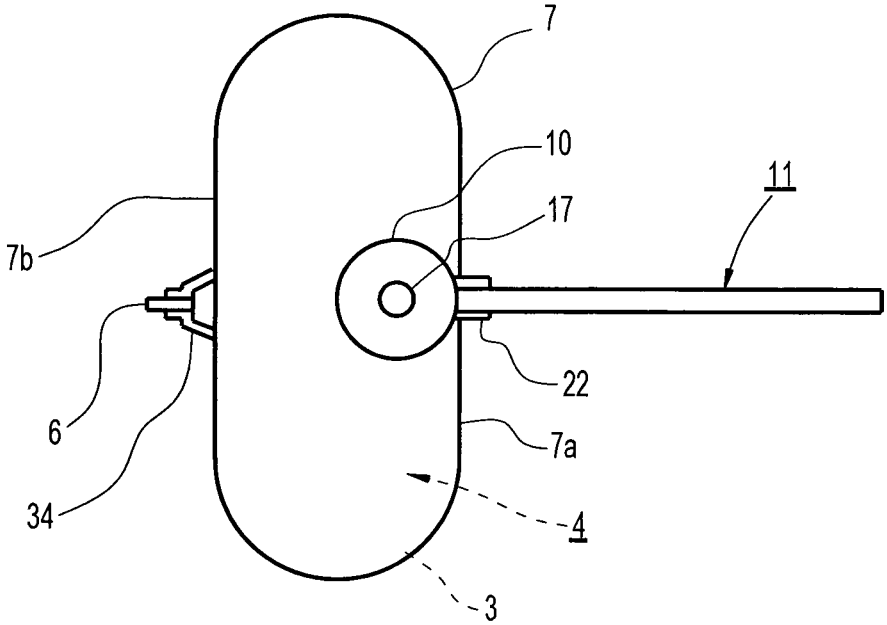
FIG. 3 depicts the device according to FIG. 1 in a plan view.
Figure 4:
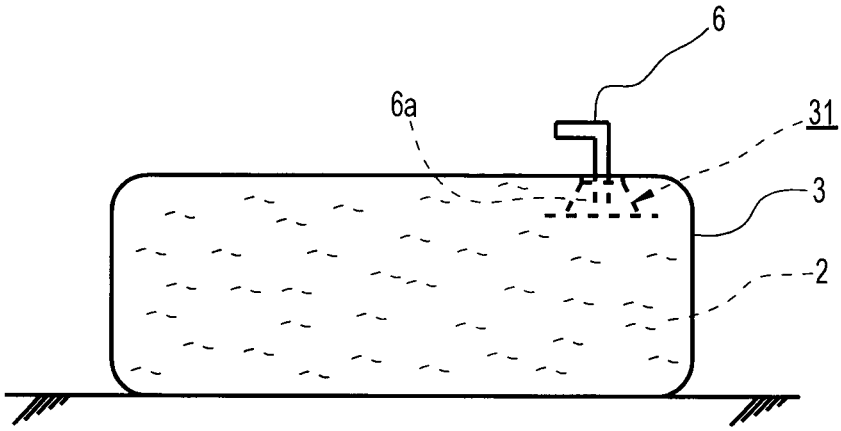
FIG. 4 depicts in a side view a container intended to be emptied by a device according to FIG. 1.

The outer container 7 need not be of upright type but may be adapted to being held in the hand during discharge. The outer container 7 as seen in plan view (see FIG. 3) may have two parallel walls 7*a*, 7*b* and the piston 17 may be disposed near to one wall 7*a*.

The nozzle may also be of some other type than as depicted. Thus the nozzle may be formed by the container, viz. by two opposite wall portions of the latter which extend along a container side between them forming a discharge duct which allows discharge of product from the container. Said opposite wall portions may be folded out from the side of the container to form a nozzle pointing outwards from the container, and if said discharge duct is initially closed it can be opened when discharge of product from the container is to take place.

It may also be mentioned that a movable compression means in the compression device may have a collar (e.g. a collar 9*a* as depicted in FIG. 1) which is directed towards a space for the container of product and which abuts against the inside of an outer container in which said container is placeable. This collar is intended to prevent the walls of the container from being pressed in between said inner wall and the compression means and thereby being firmly clamped.

The invention claimed is:

1. A device for discharge of liquid or substantially liquid products from a compressible container made of flexible material which container is placeable in an outer container and is compressible therein by a compression device in order to feed product out therefrom through a nozzle, wherein a movable compression means which forms part of the compression device is disposed on a piston or equivalent adapted to being subjected to movements in a portioning direction (P3) so that the movable compression means squeezes the container in the outer container, and that the piston with its movable compression means can perform a return movement in a return direction (P4) which is opposite to the portioning direction (P3), characterised in that the piston is adapted to being subjected to movements in the return direction (P4) by the movable compression means being pressed down by the weight of the container and the product present therein.

2. A device according to claim 1, characterised in that the piston is adapted to allow such return movements (P4), whereby the container, after having been squeezed by the movable compression means in order to feed product out from it in the opposite portioning direction (P3), can expand to prevent or hinder elements of the product still in the nozzle from dripping out of the nozzle.

3. A device according to claim 1, characterised in that the piston is adapted to undergoing movements in the return direction (P4) by the movable compression means being subject to expansion forces which the container exerts when it endeavours to revert to an original shape after it has been squeezed by the movable compression means.

4. A device according to claim 1, characterised in that the piston has a ring or equivalent which accompanies the movements of the piston.

5. A device according to claim 4, characterised in that during movements of the piston the ring can move between two stop surfaces.

6. A device according to claim 1, characterised in that an operating device can be caused to perform movements in portioning directions (P1, P2), which movements are transmissible to the piston via a movement transmission means, in that the movement transmission means is so disposed that it can assume a releasing position (F) in which it releases the piston so that the latter can move in the return direction (P4) when the movement transmission means is not acted upon by movements of the operating device in the portioning directions (P1, P2), and in that the movement transmission means is also so disposed that it can be caused by the operating device to assume a locking position (L) in which it is locked to the piston by being firmly clamped to the latter so that it can transmit the operating movements (P1, P2) of the operating device to the piston.

7. A device according to claim 1, characterised in that the compression device has a compression means which is disposed at the top of the outer container above the movable compression means being movable upwards to squeeze a container situated between said compression means and the movable compression means, and that the device allowing the return movement allows the movable compression means to perform a downward movement in a return direction (P4).

8. A device according to claim 1, characterised in that the outer container has at the top a lateral aperture through which such a portion of the container, which comprises an inner connecting portion and, connected to it, a nozzle, can be taken out of the outer container, and that the outer container has a bracket by which said portion of the container with the inner connecting portion and the nozzle can be held firmly relative to the outer container.

9. A device according to claim 1, characterised in that the movable compression means has a collar directed towards the space in which the container can be placed, which collar abuts against the inside of the outer container.

10. A device according to claim 1, characterised in that the movable compression means is removably disposed in an outer container to allow it to be taken out of the outer container so that the container can be put into and taken out of it.

11. A device according to claim 1, characterised in that the compression device comprises two compression means, of which at least the movable compression means is disposed in the outer container which has two parallel sidewalls, and the piston is a rod disposed nearer to one wall of the outer container than the other wall.

12. A device according to claim 1, characterised in that the nozzle is intended for once-only use.

* * * * *